US006899561B2

(12) United States Patent
Johann

(10) Patent No.: US 6,899,561 B2
(45) Date of Patent: May 31, 2005

(54) INTEGRATED LATCHING, AND ELECTRICAL CONNECTING DEVICE AND METHOD

(75) Inventor: Edward W. Johann, Michigan City, IN (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/642,767

(22) Filed: Aug. 19, 2003

(65) Prior Publication Data

US 2005/0042902 A1 Feb. 24, 2005

(51) Int. Cl.[7] ..... H01R 13/60

(52) U.S. Cl. ..... 439/542; 439/911; 200/50.14

(58) Field of Search ..... 439/911, 917, 534, 439/542; 200/50.01, 50.14

(56) References Cited

U.S. PATENT DOCUMENTS 2,204,002 A * 6/1940 Rowe ..... 200/50.14
5,408,219 A * 4/1995 Newman et al. ..... 439/917
5,818,015 A * 10/1998 Lee et al. ..... 200/50.14

* cited by examiner

*Primary Examiner*—Renee Luebke
(74) *Attorney, Agent, or Firm*—Baker & Hostetler LLP

(57) ABSTRACT

A method and apparatus for providing an electrical connection and latching a door is provided. The door latching electrical connection device may include a bar an electrical connector attached to the bar. The method may include placing one end of a bar and bar receiver mounted on the device and attaching the other end of the bar to a second bar receiver mounted on the device and causing the door to be blocked. The method may further include providing an electrical connector on the bar and automatically making an electrical connection by connecting the electrical connector to a second electrical connector mounted on the device when the bar is placed in the two bar receivers.

17 Claims, 2 Drawing Sheets

INTEGRATED LATCHING, AND ELECTRICAL CONNECTING DEVICE AND METHOD

FIELD OF THE INVENTION

The present invention relates generally to an integrated door latching and electrical in-line connecting device and method. More particularly, the invention relates to a device and method for latching a combustion door with an integrated electrical in-line interlock device.

BACKGROUND OF THE INVENTION

Many household and commercial appliances have combustion chambers where natural gas, propane, or oil or some other fuel may be burned. For example, boilers and furnaces used for creating hot water and/or heating include a combustion chamber where fuel is burned to provide heating for the hot water or hot air. Like any other mechanical device, these combustion appliances from time to time may require maintenance or cleaning.

In order to provide access to the combustion chamber for maintenance or cleaning, these appliances are often equipped with a combustion chamber door. The door may be opened to thereby provide access to the combustion chamber. For a variety of reasons it is important that the combustion chamber door is securely closed whenever combustion occurs within the combustion chamber.

Many appliances having combustion chambers are not always burning fuel within the combustion chamber. For example, a boiler may only burn fuel in the combustion chamber when a thermostat or other controller sends a signal to the boiler requesting it produce hot water. At other times the combustion chamber may be idle. When the boiler gets a call for heat, or is signaled to produced hot water, it may provide fuel flow to the combustion chamber and an electrical charge may ignite the fuel causing the combustion to occur. Accordingly, during operation of the appliance there will be times when there is fuel burning in the combustion chamber and other times when there is not fuel burning in the combustion chamber.

As a result of the on-again, off-again fuel burning occurring in the combustion chamber, a potential problem may arise when someone desiring to access the combustion chamber notices that there is no combustion occurring in the combustion chamber and opens the door accessesing the combustion chamber in order to clean or provide maintenance to the combustion chamber. During the time when the door is opened and the combustion chamber is exposed, if the appliance were not properly shut off or set for maintenance operations, the appliance could receive a call to produce heat and initiate the ignition sequence. The ignition sequence could provide fuel flow and an electrical signal to provide a spark to ignite the fuel in the combustion chamber and cause combustion in the combustion chamber. As previously mentioned, it is undesirable for the combustion door to be open when fuel is burning in the combustion chamber.

Accordingly, there is a need in the art for a method and apparatus that disables the combustion sequence from occurring when the combustion door is open. There is also a need for a method and apparatus that will not allow fuel to ignite in the combustion chamber when the combustion chamber access door is open.

SUMMARY OF THE INVENTION

The foregoing needs are met, to a great extent, by the present invention, wherein in one aspect an apparatus is provided that in some embodiments discloses disables combustion in an appliance whenever the combustion door is opened. In some embodiments, the electronic ignition is put in a disabled condition so it is not able to provide a spark to ignite fuel in the combustion chamber whenever the combustion door is open.

In accordance with one embodiment of the present invention, a door latching and electrical connection device for an appliance having a door is provided. The door latching and electrical connection device includes a bar that latches the door to a closed position and an electrical connector attached to the bar that provides an electrical connection between the bar and the appliance when the bar is in the latched position.

In accordance with another embodiment of the present invention, a door latching and electrical connection device for an appliance having a door is provided. The door latching and electrical connection device includes means for latching the door closed and first means providing an electrical connection between the latching means and the appliance when the door is latched closed.

In accordance with yet another embodiment of the present invention, a method of securing a door mounted on a device and making an electrical connection is provided. The method includes blocking the door with a latching bar and providing an electrical connector on the bar. The method further includes providing an electrical connector on the bar and making an electrical connection by connecting the electrical connector to a second electrical connector mounted on the device when the bar is blocking the door.

In accordance with yet another embodiment of the present invention, an apparatus is provided. The apparatus includes a bar configured to mount on the combustion device and block the door; a first electrical connector attached to the bar and a second electrical connector configured to mate with the electrical connector and provide an electrical connection when the bar is blocking the door and to disable the conduction chamber when the door is not blocked by preventing the electrical connection when the door is not blocked.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
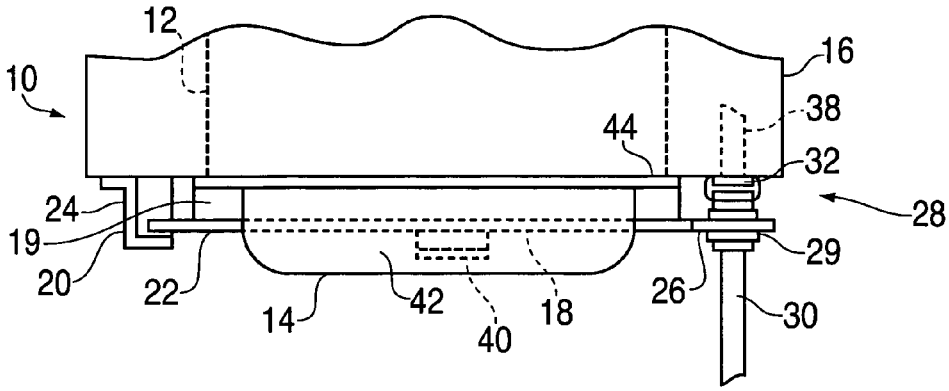
FIG. 1 is a partial top view illustrating an appliance with a combustion chamber according to a preferred embodiment of the invention.

The invention will now be described with reference to the drawing figures, in which like reference numerals refer to like parts throughout. An embodiment in accordance with the present invention provides a door latching and electrical connecting device and method.

In some embodiments of the invention, the door latching and electrical connection device can be applied to an appliance having a combustion chamber where a bar is attached to the combustion chamber to block a door providing access to the combustion chamber. A first electrical connector portion associated with the bar mates with a second electrical connector portion located on the combustion device when the door is closed. The ignition sequence for initiating combustion within the combustion chamber can not occur unless the electrical connection between the bar and the electrical connector on the combustion device is made.

In other embodiments of the invention, a method is provided of securing a door mounted on a device and making an electrical connection. The method includes blocking a door with a latching bar and providing an electrical connector on the bar. The method may also include automatically making an electrical connection by connecting the electrical connector to a second electrical connector mounted on the device when the bar is placed to block the door.

An embodiment of the present inventive apparatus illustrated in FIG. 1. FIG. 1 is a partial top view of an apparatus 10 having a combustion chamber 12. The combustion chamber 12 is defined at least in part by a door 14. The door 14 also provides access to the combustion chamber 12. The combustion chamber 12 is contained within a housing 16 associated with the device 10. The door 14 is located on the housing 16. To secure the door 14, a latching bar 18 is provided.

According to some embodiments of the invention, the latching bar 18 attaches to the housing 16 via a retaining bracket 20. One end 22 of the latching bar 18 is seated within the retaining bracket 20. The retaining bracket 20 has a floor portion 24 for the end 22 of the latching bar 18 to rest on when the latching bar 18 is in place. The other end 26 of the latching bar 18 is fitted with an inline electrical interlock 28 which may also be referred to in this document as a plug 28. The plug or inline interlock device 28 terminates a wire harness, preferably having four wires, but not limited to four wires. The wires are contained in a flexible conduit 30.

The latch bar 18 attaches to the plug 28 rather than the flexible conduit 30. Attaching the latch bar 18 to the plug 28 rather than the conduit 30 reduces the strain the conduit 30 experiences when the latch bar 18 is removed from the device 10.

According to some embodiments of the current invention, the plug 28 is a MOLEX® plug (shown in FIGS. 3 and 4 and explained in detail below.) Other embodiments of the invention may include the use of other suitable type plugs. The use of a MOLEX® plug is meant to be exemplary. The plug 28 is configured to mate with the second inline interlock device or plug 32 mounted on the housing 16 on the appliance 10. According to some embodiments of the invention, the bar 18 is supported at one end 26 by the connection made when the plug 28 is mated with the plug 32. The other end 22 the bar 18 is supported by the floor 24 of the retaining bracket 20. Other embodiments include supporting both ends of the bar with retaining brackets or by other means well known in the art.

Figure 2:
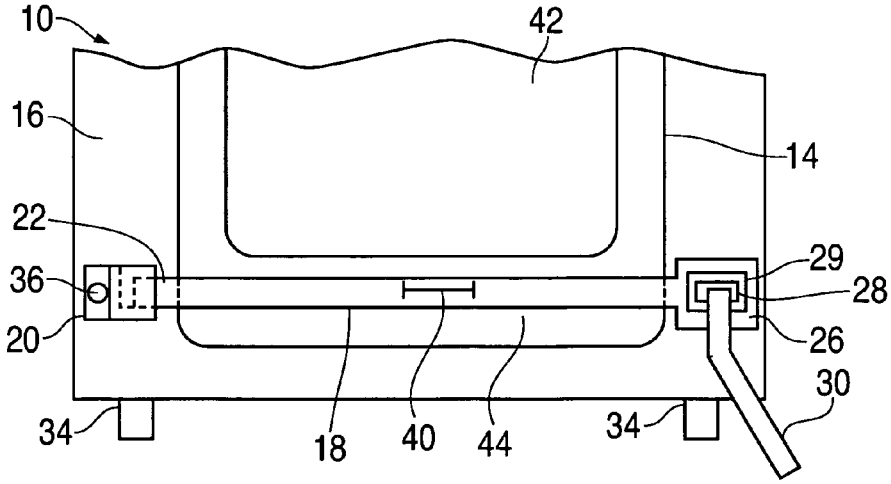
FIG. 2 is a partial front view of the appliance illustrated in FIG. 1.

FIG. 2 is a partial front view of the apparatus 10 shown in FIG. 1. The appliance 10 is supported by feet 34. The appliance 10 has a housing 16 with the retaining bracket 20 attached to the housing 16 by a machine screw 36 or similar fastener. The latching bar 18 is placed in the latching position securing the burner door 14 in the closed position. One end 22 of the latching bar 18 is mounted in the retaining bracket 20 and the other end 26 is supported by the connection made by the electrical connectors 28 and 32 (shown in FIG. 1). The electrical connectors 28 and 32 are electrically connected to the wires contained in the flexible conduit 30 and 38. An electronic signal is sent through the wires in the conduit 30 through the electrical connector 28 to the electrical connector 32 electrically connected to an igniter or other device that initiates burning within the combustion chamber 12. Thus, if the electrical connection between plugs 28 and 32 is broken, then the ignition sequence can not proceed.

In some embodiments of the invention, the electrical connection between plugs 28 and 32 may be required to sustain combustion in the combustion chamber 12. Some apparatus may be configured so that if the electrical connection is broken, the fuel supply will be cut off to the combustion chamber causing combustion to cease. Other embodiments may cause combustion to cease when the electrical connection is broken by other means known in the art.

In some embodiments of the invention, a handle 40 is attached to the latching bar 18 to provide an easy means for grabbing and moving the latching bar 18. In some embodiments of the invention the latching bar 18 has insulation 19 attached to it on the side of the latching bar 18 that contacts the combustion door 14 in order to reduce an amount of heat that the latching bar 18 absorbs by contacting the combustion door 14. In some embodiments of the invention, the latching bar 18 has insulation 29 surrounding the plug 28 in order to provide electrical insulation between the plug 28 and the latching bar 18.

As shown in FIGS. 1 and 2, the burner door 14 has a wide portion 42 and a narrow portion 44. The latching bar 18 is configured to fit across the narrow portion 44. However, this embodiment is meant to be illustrative only and not limiting to the invention. Other embodiments of the invention may include a rounded or contoured door 14. The latching bar 18 may be rounded or contoured in order to complement the profile of the burner door 14. Not all embodiments of the invention will include the use of variable contoured doors.

Figure 3:
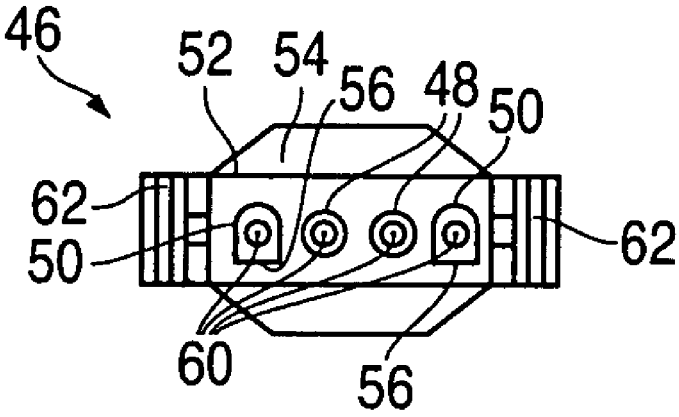
FIG. 3 is a front view of a male plug portion of a plug in accordance with the invention.

A male plug 46 shown in FIG. 3 is one type of plug that may be used in accordance with the invention. As shown in FIG. 1, there is a first plug portion 28 attached to the bar 18 and another plug portion 32 attached to the boiler 10. One or the other plugs 28 or 32 will be a male plug 46 and the other plug will be a female plug 58. Returning now to FIG. 3, the male plug 46 is shown as a four prong plug where each prong 48 and 50 corresponds to a wire attached to the plug 46. The plug 46 shown in FIG. 3 is, for example, a plug manufactured and known under the trade name MOLEX®. The plug 46 has a housing 52 which attaches to the conduit 30 or 38 (shown in FIG. 1). The connection between the conduit 30 or 38 (shown in FIG. 1) and the plug 46 is wrapped by an insulating sleeve 54.

Extending from the housing 52 are four prongs 48 and 50. The outer prongs 50 have a flat spot 56 which acts as a key when inserted in the corresponding female receiving plug 58 (shown in FIG. 4). The inner two prongs 48 are round prongs. Within the prongs 48 and 50 are male electrical connections 60 made of a conductive metal. The connections 60 electrically communicate with corresponding wires contained within the conduit 30 or 38. Attached to the housing 46 is latching structure 62. Latching structure 62 is attached to the outer edges of the housing 52 and is flexible and latches to corresponding structure 64 on the female plug 58 shown in FIG. 4.

Figure 4:
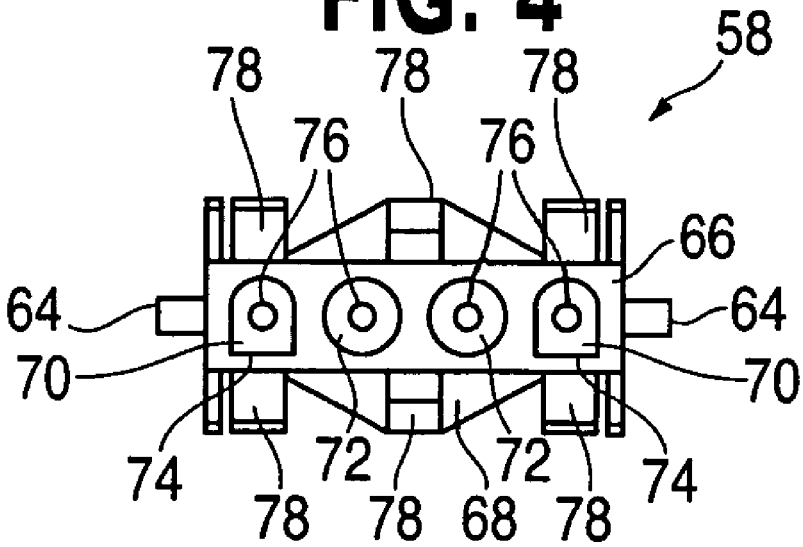
FIG. 4 is a front view of a female plug portion corresponding to the plug shown in FIG. 3.

The female plug 58 shown in FIG. 4 has a housing 66. The housing 66 attaches to the flexible conduit 30 or 38 (shown in FIG. 1) and the connection between the conduit 30 or 38 and plug 58 is surrounded by an insulating sleeve 68. Extended from the housing 66 are four prongs 70 and 72 configured to mate with the male prongs 46 and 48. The outer two prongs 70 have a flat spot 74 on the bottom which correspond to the flat spots 56 on the male plug 46. The inner two prongs 72 are configured to mate with the male prongs 48. Within the prongs 70 and 72 are electrical connections 76. The electrical connections 76 may be configured to mate and electrically communicate with corresponding male electrical connections 60. The prongs 48 and 50 of the male plug 46 will slide inside the receiving prongs 72 and 74 of the female plug 58.

Latching "ears" 64 are mounted on the housing 66 of the female plug 58 and provide structure for the latches 62 on the male plug 46 to latch on to. The interaction of the latches 62 and latching ears 64 provide a secure connection when the male plug 46 is attached to the female plug 58. The female plug 58 also has other latching structure 78 that may be adapted when other types of male plugs are used rather than the one shown in FIG. 3. While FIGS. 3 and 4 show a particular type of plug that is used in accordance with the invention, many other types of plugs can be used in accordance with the invention the plugs shown in FIGS. 3 and 4 are meant to be exemplary only and not limiting to the invention. The prongs are preferably of a male-female type but other electrically connecting devices can be used.

The configuration of the appliance as shown in the drawings is meant to be exemplary only and not limiting. The location of and particular attaching arraignment for the latching bar 18 can be varied according to the needs and circumstances to which the latching bar 18 will be used. Although the integrated latching bar 18 and electrical connection is shown and described as associated with latching a combustion door shut on an combusting appliance, it will be appreciated that the integrated latching bar 18 and plug can be used in other circumstances. The integrated latching bar 18 can be used anytime it is desired to secure something closed and also provide an electrical connection. For example, it could be used as part of a security system. When the latching bar 18 is removed to provide access to open a window or door, the electrical connection is broken thus alerting the electronic the security system that the latching bar is no longer in a securing position. In sum, the invention may be used in a variety of applications and industries not particularly associated with combustion devices.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A latching and electrical connection device for an appliance having a door, comprising:

a bar that latches the door in a closed position;

a first electrical connector attached to the bar that provides a connection between the bar and the appliance when the bar is in a latched position;

a combustion device having a combustion chamber;

an attaching member configured to secure one end of the bar to the combustion device in a manner to cause the bar to block the door from opening when the bar is in the latched position;

a second electrical connector configured to mate with the first electrical connector and provide an electrical connection when the bar is in the latched position; and insulation mounted on the bar and configured to impede heat transfer from the combustion device to the bar.

2. The door latching and electrical connection device of claim 1, wherein the bar has two ends and the electrical connector is attached to one end of the bar.

3. The door latching and electrical connection device of claim 1, further comprising a handle attached to the bar.

4. The door latching and electrical connection device of claim 1, further comprising electrical insulation surrounding the electrical connector and configured to insulate the electrical connector from the bar.

5. A latching and electrical connection device for an appliance having a door, comprising:

a bar that latches the door in a closed position;

a first electrical connector attached to the bar that provides a connection between the bar and the appliance when the bar is in a latched position;

a combustion device having a combustion chamber; and an attaching member configured to secure one end of the bar to the combustion device in a manner to cause the bar to block the door from opening when the bar is in the latched position;

a second electrical connector configured to mate with the first electrical connector and provide an electrical connection when the bar is in the latched position, wherein combustion may only be initiated in the combustion chamber when an electrical connection is made by the first electrical connector with the second electrical connector.

6. The door latching and electrical connection device of claim 5, wherein the bar is contoured to complement the shape of the door.

7. The door latching and electrical connection device of claim 5, wherein one of the first and second electrical connectors includes a plug with keyed prongs.

8. The door latching and electrical connection device of claim 5, wherein combustion can only occur in the combustion chamber when an electrical connection exists between the first electrical connector and the second electrical connector.

9. A door latching and electrical connection device for an appliance having a door, comprising:

means for positioning a first end of a latching bar so as to latch the door closed;

first electrical connection means for providing an electrical connection between the latching bar and the appliance when the door is latched closed;

a combustion device having a combustion chamber;

a door attached to the combustion device and configured to provide access to the combustion chamber;

an attaching member configured to secure the first end of the latching bar to the combustion device in a manner to cause the latching bar to block the door from opening;

second electrical connection means for providing an electrical connection configured to mate with the first electrical connection means to provide an electrical connection when the door is latched closed by the latching bar;

a latching structure attached to the first electrical connection means and latching to a corresponding structure on the second electrical connection means; and means for impeding heat transfer from the combustion device to the latching bar, wherein the means for impeding heat transfer comprises a thermally resistive component interposed between the combustion device and at least a portion of the latching bar.

10. The door latching and electrical connection device of claim 9, further comprising means for gripping the latching bar.

11. The door latching and electrical connection device of claim 9, further comprising electrical insulation surrounding the means for providing an electrical connection and configured to insulate the electrical connection from the latching bar.

12. The door latching and electrical connection device of claim 9, wherein combustion may only be initiated in the combustion chamber when an electrical connection is made between the first means for providing an electrical connection and the second means for providing an electrical connection.

13. The door latching and electrical connection device of claim 9, wherein combustion may only occur in the combustion chamber when an electrical connection exists between the first means for providing an electrical connection and the second means for providing an electrical connection.

14. A method of securing a door mounted on a device and making an electrical connection comprising:

blocking the door with a latching bar;

providing an electrical connector on the bar;

making an electrical connection by connecting the electrical connector to a second electrical connector mounted on the device when the bar is blocking the door; and stopping combustion in the device when the electrical connection is broken.

15. The method of claim 14, further comprising breaking the electrical connection when the bar is not blocking the door.

16. The method of claim 14, further comprising sending an electronic signal through the electrical connection to initiate burning in a combustion chamber.

17. The method of claim 14, further comprising moving the bar using a handle on the bar.

* * * * *